United States Patent [19]

Janutta

[11] Patent Number: 4,574,768

[45] Date of Patent: Mar. 11, 1986

[54] SUPPORT FOR ROTARY MATERIAL REMOVING TOOLS IN GRINDING MACHINES

[75] Inventor: Reinhard Janutta, Geesthacht, Fed. Rep. of Germany

[73] Assignee: Hauni-Werke Körber & Co. KG, Hamburg, Fed. Rep. of Germany

[21] Appl. No.: 626,670

[22] Filed: Jul. 2, 1984

[30] Foreign Application Priority Data

Jul. 6, 1983 [DE] Fed. Rep. of Germany ..... 3324322

[51] Int. Cl.[4] ..... B24B 53/14

[52] U.S. Cl. ..... 125/11 CD; 51/166 MH; 384/493; 384/905

[58] Field of Search ..... 51/166 MH, 58; 125/11 CD; 384/905, 557, 605, 493, 443

[56] References Cited

U.S. PATENT DOCUMENTS 2,106,034 1/1938 Mall ..... 51/166 MH 2,601,290 6/1952 Hopkins ..... 125/11 CD 2,926,651 3/1960 Balsiger ..... 125/11 CD 3,755,970 9/1973 Parr ..... 51/58

*Primary Examiner*—Harold D. Whitehead

*Attorney, Agent, or Firm*—Peter K. Kontler

[57] ABSTRACT

The shaft of a dressing tool for grinding wheels is rotatable in two spaced-apart sets of roller bearings each of which is mounted in the radially extending leg of a discrete housing section. The two sections are connected to each other by two packages of leaf springs which extend radially of and are disposed at one side of the shaft and allow for uninterrupted thermally induced changes in the length of the shaft while preventing appreciable radial movements of the two sets of bearings relative to each other. One radially extending leg is integral with a third leg which is spaced apart from and is parallel to the shaft and is connected with the other radially extending leg by the two packages of leaf springs.

8 Claims, 2 Drawing Figures

SUPPORT FOR ROTARY MATERIAL REMOVING TOOLS IN GRINDING MACHINES

BACKGROUND OF THE INVENTION

The present invention relates to mountings for rotatory parts, and more particularly to supports for the shafts, spindles or analogous rotary elements (hereinafter called shafts for short) which carry and transmit torque to or receive torque from tools in material removing machines.

It is known to mount two spaced-apart portions of a shaft for a grinding or dressing tool in discrete antifriction bearings which, in turn, are mounted in a housing or frame in such a way that they allow for thermally induced changes in the length of the shaft. Such mounting is advantageous in connection with rotatory wheel-shaped dressing tools which are used to treat the working surfaces of grinding wheels in surface grinding or other types of grinding machines.

The grinding wheel or wheels of a grinding machine must be dressed, either continuously or at certain intervals, in order to ensure that the profile of the working surface of each grinding wheel matches an optimum outline which ensures adequate treatment of workpieces. Continuous or frequent dressing of the working surfaces of grinding wheels is especially desirable in modern high-precision grinding machines which must treat selected surfaces of workpieces with an extremely high degree of accuracy. In order to allow for thermally induced changes in the axial length of the shaft which carries the dressing tool, such shaft is normally mounted in a fixedly installed bearing (i.e., a bearing which is held against axial movement) and in a loosely mounted bearing which can move axially toward or away from the fixedly installed bearing. This enables the shaft for the dressing tool (which is mounted on the shaft between the two bearings) to move the loosely installed bearing axially toward or away from the fixedly installed bearing. As a rule, the fixedly installed bearing is a needle bearing. This is considered desirable and advantageous because a needle bearing allows for uninterrupted changes in the length of the shaft so that such changes can be readily compensated for by an experienced attendant who is in charge of supervising and regulating the dressing operation or by an automatic compensating system if the dressing tool is installed or put to use in a numerically controlled or otherwise programmed grinding machine.

However, needle bearings cannot be used when the dressing tool must treat the working surfaces of grinding wheels in modern heavy-duty grinding machines. Needle bearings cannot stand pronounced stresses which arise in such material removing machines and, therefore, they must be replaced with sturdier and more stress-resistant roller bearings. On the other hand, the bearings which can stand much higher stresses than a needle bearing exhibit the drawback that they do not allow for uninterrupted shortening or lengthening of the shaft for a grinding wheel, dressing tool or an analogous tool in a grinding or another material removing machine. On the contrary, rather than allowing for uninterrupted changes in the axial length of the shaft (i.e., for a change whenever the need arises in view of the changing temperature of the shaft), such bearings merely allow for jerky or sporadic changes in the axial length of the shaft (this is known as the stick-slip effect). Thus, the loose bearing can move toward or away from the fixedly installed bearing only when the stresses which develop as a result of the tendency of the shaft to change its length reach a predetermined value. Each such rise of stresses is followed by an abrupt shifting of the loose bearing in a direction toward or away from the fixedly installed bearing. The just described mode of changing the length of the shaft prevents even a highly skilled attendant from adequately compensating for changes in the axial length of the shaft (i.e., from ensuring adequate dressing of the working surface of the grinding wheel) and, in fact, even a highly sophisticated automatic compensating system of a numerically controlled or other ultramodern grinding machine is incapable of coping with this problem.

German Offenlegungsschrift No. 27 47 976 of Voumard discloses a support for the shaft or spindle of a grinding wheel which employs a membrane serving to connect a stationary housing part (stator) with an axially movable ball bearing for one end portion of the shaft. Such membrane allows for shortening or lengthening of the shaft in response to changes in temperature. However, and since the central portion of the membrane is connected to the loose bearing and the marginal portion of the membrane is connected to the stator all the way around the bearing, all changes in the length of the shaft entail the development of very pronounced tensional stresses in addition to equally pronounced bending or flexing stresses. The tensional stresses are transmitted to the stator as well as to the loose bearing with attendant highly pronounced wear upon and stray movements of the shaft and the material removing tool thereon. Proposals to reduce such tensional stresses involve the utilization of a specially designed membrane with marginal cutouts to enhance the flexibility of the respective sections. This contributes significantly to the initial cost of the support for the shaft as well as to the cost of maintaining the support in proper condition and of monitoring the distribution of stresses in the membrane and/or in the parts which are connected to the membrane.

An additional drawback of a membrane is that its rigidity changes unpredictably in response to relatively small deformation so that the resistance of the membrane to axial and/or radial movements of the loose bearing is quite erratic as soon as the membrane undergoes a relatively small amount of deformation. This prevents the attendants from adequately compensating for changes in the axial position of the dressing tool relative to the grinding wheel when the length of the shaft for the dressing tool changes. The same holds true for the equipment which is used in a modern grinding machine to effect an automatic compensation for axial shifting of the dressing tool.

OBJECTS AND SUMMARY OF THE INVENTION

An object of the invention is to provide a novel and improved support for the shafts of grinding wheels, dressing wheels and analogous material removing tools which is constructed and assembled in such a way that it invariably allows for uninterrupted changes in the length of the shaft for the rotary tool even if the shaft is mounted in bearings other than needle bearings and irrespective of the extent of changes in the length of the shaft.

Another object of the invention is to provide a novel and improved support for the shaft or spindle of a dressing tool.

A further object of the invention is to provide a machine which embodies the improved support.

An additional object of the invention is to provide a dressing apparatus which embodies the improved support.

Still another object of the invention is to provide a support which can be used in automatic grinding or like machines wherein changes in the length of the shaft for the grinding wheel or dressing tool are compensated for by automatic compensating means.

A further object of the invention is to provide a support which can be used in existing grinding machines or dressing apparatus as a superior and longer-lasting substitute for heretofore known supports.

Another object of the invention is to provide a novel and improved method of mounting the shaft for a grinding wheel, a dressing wheel or an analogous material removing tool in machines wherein the shaft is likely to undergo frequent and pronounced changes in length as a result of changes of the ambient temperature.

An additional object of the invention is to provide the support with novel and improved means for allowing controlled movements of one bearing for the shaft relative to another bearing.

The improved support serves to rotatably mount a material removing tool, such as a dressing tool for grinding wheels, and comprises a shaft, first and second bearings which surround spaced-apart portions of the shaft (preferably at the opposite axial ends of a rotatable wheel-shaped dressing tool on the shaft), and a housing for the two bearings. The housing comprises first and second sections which respectively receive the first and the second bearings, and a yieldable compensating device for temperature-induced changes in the length of the shaft. The compensating device comprises a plurality of springs which connect the two sections of the housing to one another for movement axially of the shaft but against appreciable movement radially of the shaft.

In accordance with a presently preferred embodiment of the invention, the springs are leaf springs which form at least one package of parallel leaf springs disposed at least substantially radially of the shaft. The leaf springs can form two discrete packages both disposed at one and the same side of the shaft.

The first section can include a first leg which extends substantially radially of the shaft and mounts the first bearing and a second leg which is rigid with the first leg, which extends in substantial parallelism with the shaft and which is spaced apart from the shaft. The second section of the housing then preferably comprises a third leg which extends substantially radially of the shaft and mounts the second bearing, and the compensating device then further includes screws, bolts or other suitable fasteners which secure the springs to the second and third legs.

The bearings preferably constitute roller bearings and each bearing can be assembled of a full set of discrete coaxial roller bearings or other suitable antifriction bearings.

All of the springs are preferably elongated leaf springs which are parallel to each other and all of which are disposed at one and the same side of the shaft radially outwardly adjacent to one of the bearings. The springs are mounted in such a way that they can be flexed only in directions to allow for movements of the two bearings axially toward or away from each other.

The novel features which are considered as characteristic of the invention are set forth in particular in the appended claims. The improved support itself, however, both as to its construction and the mode of assembling the same, together with additional features and advantages thereof, will be best understood upon perusal of the following detailed description of certain specific embodiments with reference to the accompanying drawing.

DESCRIPTION OF THE PREFERRED EMBODIMENTS

Figure 2:
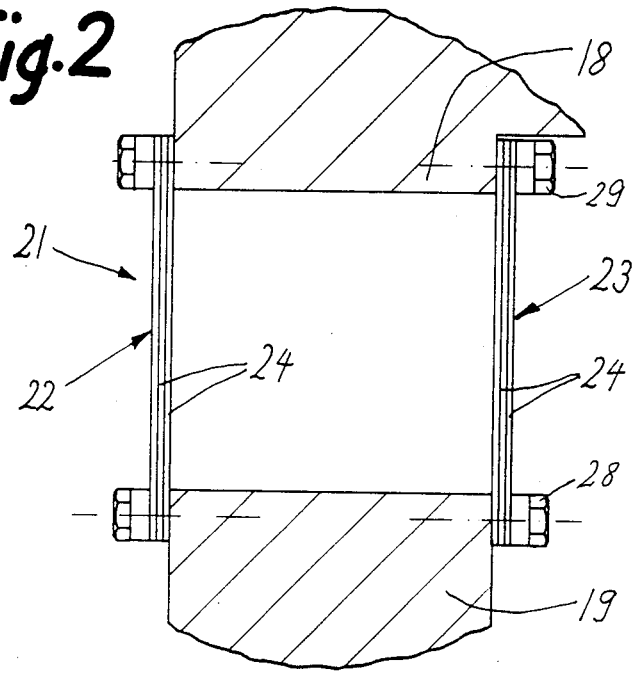
FIG. 2 is an enlarged view of a detail within the phantom-line circle II in FIG. 1.
Figure 1:
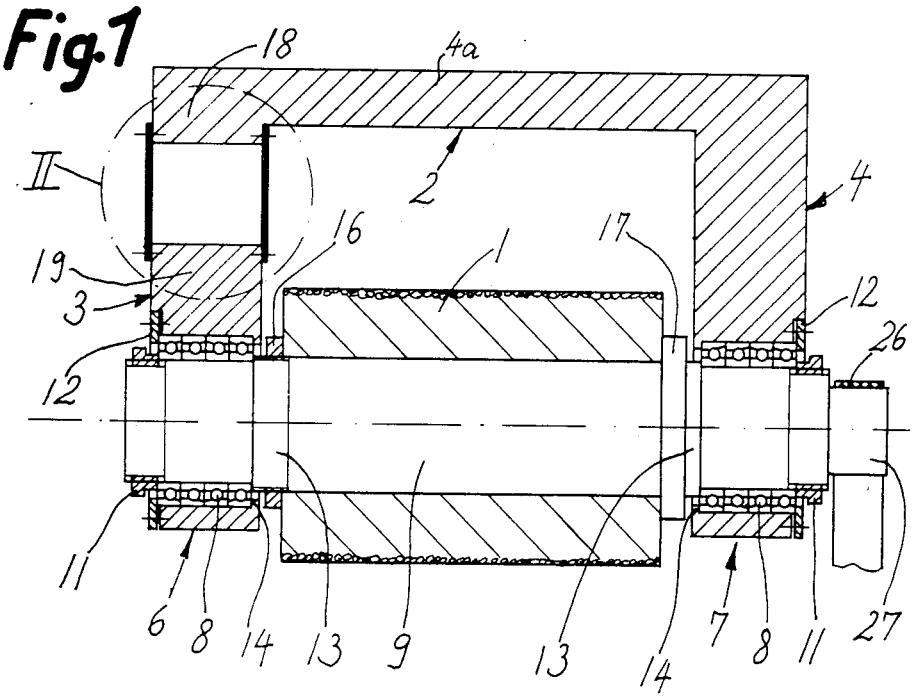
FIG. 1 is an axial sectional view of a support which embodies the invention and serves to rotatably carry a wheel-shaped dressing tool for grinding wheels.

The support which is shown in the drawing includes an elongated shaft or spindle 9 which transmits torque to a wheel-shaped dressing tool 1. The end portions of the shaft 9 extend beyond the respective end faces of the tool 1 and into sets of coaxial roller bearings 8 which together constitute a first composite antifriction bearing 7 and a second composite antifriction bearing 6. The bearings 6 and 7 are mounted in a housing 2 which includes a one-piece first section composed of a first leg 4 and a second leg **4*a*, and a second section including a leg 3 extending radially of the shaft 9, the same as the leg 4. The leg 4*a* is spaced apart from and is substantially parallel to the shaft 9 and dressing tool 1. The dressing tool 1 is held in a selected axial position by two internally threaded rings 16, 17 which mate with external threads on the adjacent portions 13 of the shaft 9. The roller bearings 8 of the composite bearing 6 are held together by an inwardly extending collar 14 of the leg 3 and by a washer 12 which is recessed into the exposed side of the leg 3 and is urged in a direction toward the nearest bearing 8 by an internally threaded ring 11 which is in mesh with the respective end portion of the shaft 9. The roller bearings 8 of the composite bearing 7 are urged against each other and against an internal shoulder 14 of the leg 4 by a washer 12 which is recessed into the outer side of the leg 4 and by an internally threaded ring 11 which mates with the respective end portion of the shaft 9. As shown, the washers 12 engage the outer races of the adjacent roller bearings 8 and the rings 11 engage the inner races of the adjacent roller bearings 8. The ring 17 can constitute an integral collar of the shaft 9 and the right-hand end face of the tool 1 is then urged against such collar by the internally threaded ring 16 which must be removed in order to allow for detachment of the tool 1 from the shaft 9**.

The leg **4*a* of the larger section of the housing 2 comprises a short portion 18 which extends radially inwardly toward the composite bearing 6 and is in register with the outer portion 19 of the leg 3. The gap between the portions 18 and 19 is bridged by a plurality of leaf springs 24 which are assembled into two packages 22 and 23 constituting a compensating device 21. These packages allow the leg 3 to move relative to the leg 4 in the axial direction of the shaft 9 when the length of the shaft changes in response to temperature changes. The leaf springs 24 of the two packages 22 and 23 are disposed in parallel planes which are normal to the axis of the shaft 9 and allow the bearing 6 to move axially toward or away from the bearing 7 while simultaneously holding the bearing 6 against any appreciable movements radially of the shaft 9. It will be noted that all of the leaf springs 24 are disposed at one and the same side of the shaft 9, namely at that side which faces the leg 4***a* of the first section of the housing 2. The means for fixedly securing the inner end portions of the packages 22, 23 to the respective sides of the section or leg 3 includes a first set of screws 28 or other suitable fasteners, and analogous or identical fasteners 29 are provided to connect the outer end portions of the packages 22, 23 to the respective sides of the radially extending portion 18 of the leg 4*a*. It has been found that the packages 22, 23 of leaf springs 24 allow for an uninterrupted (substantial or minimal) axial shifting of the bearing 6 relative to the bearing 7 and/or vice versa so as to account, at any given time, for changes in the length of the shaft 9. Such continuous movability of the bearing 6 in the axial direction of the shaft 9 does not in any way affect the ability of the leaf springs 24 to hold the bearing 6 against appreciable radial movements.

The shaft 9 is driven by a motor (not shown) which transmits torque by way of a toothed belt 26 and a toothed pulley 27. The latter is affixed to the shaft 9 outwardly of the leg 4.

It has been found that the compensating device 21 which includes the leaf springs 24 is superior to the membrane which is utilized in the structure disclosed in the aforediscussed German Offenlegungsschrift of Voumard. This is due, in part, to the fact that the leaf springs 24 are subjected practically exclusively to bending stresses in view of their aforediscussed mounting in planes extending at right angles to the axis of the shaft 9 and also because all of the leaf springs 24 are located at one and the same side of the shaft 9. The ability of the packages 22, 23 of leaf springs 24 to stand radial stresses and to thus prevent undesirable radial movements of the bearing 6 is at least as satisfactory as that of a membrane which is mounted in a manner as proposed by Voumard. The leaf springs 24 do not transmit to the housing 2 any pronounced deforming stresses such as will be transmitted if the connection between one of the composite bearings and the housing is established by way of a membrane which is mounted in a manner as proposed by Voumard. Still further, the resistance of the leaf springs 24 to axially oriented stresses increases linearly with increasing magnitude of deforming stresses within a very wide range. This is highly desirable irrespective of whether the changes in axial position of the tool 1 in response to changes in the length of the shaft 9 are compensated for by an attendant or by automatic controls of a programmed grinding machine.

An important advantage of the improved support is that it allows for changes in the axial position of the bearing 6 relative to the bearing 7 and/or vice versa whenever the need for such changes arises, i.e., as soon as the length of the shaft 9 increases or decreases. Furthermore, such changes in the axial positions of the bearings 6, 7 relative to each other can be minimal or more pronounced, depending on the temperature-induced changes of the length of the shaft 9, and each and every change takes place in immediate response to a lengthening or shortening of the shaft, i.e., the improved support does not exhibit the aforediscussed stick-slip-effect. Still further, radial stability of the bearings 6, 7 is not influenced by the extent and/or frequency of axial movement of these bearings relative to one another. All of these are highly desirable prerequisites for predictable and accurate compensation for axial shifting of the tool 1, either by an attendant or by the automatic controls of a sophisticated machine tool.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. A support for a material removing tool, such as a dressing tool for grinding wheels, comprising a shaft; first and second bearings surrounding spaced-apart portions of said shaft; and a housing for said bearings, said housing including first and second sections respectively receiving said first and second bearings and a yieldable compensating device for temperature-induced changes in the length of said shaft, including a plurality of leaf springs extending substantially radially of said shaft and connecting said sections to one another for movement axially of said shaft but against appreciable movement radially of said shaft.

2. The support of claim 1, wherein said springs form at least one package of parallel leaf springs.

3. The support of claim 2, wherein said leaf springs form two discrete packages both disposed at one and the same side of the axis of said shaft.

4. The support of claim 1, wherein said first section includes a first leg extending substantially radially of said shaft and mounting said first bearing and a second leg rigid with said first leg and spaced apart from and substantially parallel to said shaft, said second section including a third leg mounting said second bearing and extending substantially radially of said shaft, said compensating device further comprising fastener means securing said springs to said second and third legs.

5. The support of claim 1, wherein said bearings include roller bearings.

6. The support of claim 1, wherein said compensating device is radially outwardly adjacent to one side of one of said bearings.

7. The support of claim 6, wherein each of said bearings comprises a plurality of coaxial antifriction bearings.

8. The support of claim 1, wherein all of said springs are elongated leaf springs which are parallel to each other, which are disposed at one side of one of said bearings, and which are flexible only in directions to allow said bearings to move axially toward or away from each other.

* * * * *